US011813768B2

(12) United States Patent
Aoyama

(10) Patent No.: US 11,813,768 B2
(45) Date of Patent: Nov. 14, 2023

(54) PORTABLE MACHINING APPARATUS WITH MOUNT TO RECEIVE AND RETAIN AN AUXILIARY FITTING

(71) Applicant: MAKITA CORPORATION, Anjo (JP)

(72) Inventor: Syuji Aoyama, Anjo (JP)

(73) Assignee: MAKITA CORPORATION, Anjo (JP)

( * ) Notice: Subject to any disclaimer, the term of this patent is extended or adjusted under 35 U.S.C. 154(b) by 44 days.

(21) Appl. No.: 17/196,494

(22) Filed: Mar. 9, 2021

(65) Prior Publication Data

US 2021/0362365 A1 Nov. 25, 2021

(30) Foreign Application Priority Data

May 22, 2020 (JP) ..... 2020-089441

(51) Int. Cl.
*B27B 9/04* (2006.01)
*B27B 9/02* (2006.01)

(52) U.S. Cl.
CPC . *B27B 9/04* (2013.01); *B27B 9/02* (2013.01)

(58) Field of Classification Search
CPC .. B27B 9/04; B27B 9/02; B23D 45/16; B23D 47/00
USPC ..... 411/970, 103, 116, 967
See application file for complete search history.

(56) References Cited

U.S. PATENT DOCUMENTS 2,101,287 A * 12/1937 Tinnerman ..... F16B 37/041 126/39 B
2,159,573 A * 5/1939 Tinnerman ..... F16B 37/044 411/970
2,552,499 A * 5/1951 Tinnerman ..... F16B 37/044 411/970
2,562,002 A * 7/1951 Tinnerman ..... F16B 37/041 411/173
2,861,618 A * 11/1958 Tinnerman ..... F16B 37/041 411/116
3,035,624 A * 5/1962 Jaworski ..... F16B 37/044 411/112
3,635,272 A * 1/1972 Scheffer ..... F16B 39/34 411/303

(Continued)

FOREIGN PATENT DOCUMENTS

CN 207127333 U * 3/2018
JP 2006-159786 A 6/2006

(Continued)

*Primary Examiner* — Jonathan G Riley
(74) *Attorney, Agent, or Firm* — Oliff PLC

(57) ABSTRACT

An attachment structure for attaching an auxiliary fitting such as a parallel ruler to a portable machining apparatus allows simpler assembly and maintenance. A portable machining apparatus includes a base having a lower surface to be in contact with a workpiece, a machining body supported on an upper surface of the base, and a mount that receives an auxiliary fitting removably attachable to the base. The mount includes an internal threaded fastener detachably supported on the base, an external threaded fastener screwed with the internal threaded fastener to be tightened with the internal threaded fastener to press the auxiliary fitting onto the base, and a locking section that locks the external threaded fastener with respect to the internal threaded fastener.

4 Claims, 12 Drawing Sheets

(56) References Cited

U.S. PATENT DOCUMENTS

| | | | | | |
|---|---|---|---|---|---|
| 3,797,548 | A * | 3/1974 | Barnett | F16B 39/38 | 411/174 |
| 4,219,064 | A * | 8/1980 | Lozano | F16B 37/044 | 411/103 |
| 5,114,203 | A * | 5/1992 | Carnes | F16B 5/123 | 296/57.1 |
| 8,651,443 | B2 * | 2/2014 | Mayer | G01D 5/244 | 248/500 |
| 2010/0307307 | A1 * | 12/2010 | Butler | B23D 59/006 | 83/477.2 |
| 2017/0326660 | A1 | 11/2017 | Nakashima | | |

FOREIGN PATENT DOCUMENTS

| | | | |
|---|---|---|---|
| JP | 2007-130693 | A | 5/2007 |
| JP | 2013-248740 | A | 12/2013 |
| JP | 2017-206003 | A | 11/2017 |
| JP | 2018-039100 | A | 3/2018 |
| WO | WO-2021010136 | A1 * | 1/2021 |

* cited by examiner

PORTABLE MACHINING APPARATUS WITH MOUNT TO RECEIVE AND RETAIN AN AUXILIARY FITTING

CROSS-REFERENCE TO RELATED APPLICATIONS

This application claims the benefit of priority to Japanese Patent Application No. 2020-089441, filed on May 22, 2020, the entire contents of which are hereby incorporated by reference.

BACKGROUND

1. Technical Field

The present disclosure relates to a portable machining apparatus that is held by an operator's hand and moved to perform cutting or other machining work.

2. Description of the Background

A parallel ruler may be used to guide a portable machining apparatus parallel to an edge of a workpiece. The parallel ruler is attached to a base of the portable machining apparatus. The base includes a ruler mount on which a leg of the parallel ruler is to be fastened.

Japanese Unexamined Patent Application Publication No. 2013-248740 (hereafter, Patent Literature 1) describes a technique for fastening a parallel ruler to a portable machining apparatus by tightening an external threaded fastener with an internal threaded portion of a base of the portable machining apparatus and pressing a distal end of the external threaded fastener against a leg of the parallel ruler with a metal plate between them.

Japanese Unexamined Patent Application Publication No. 2017-206003 (hereafter, Patent Literature 2) describes a technique for fastening a parallel ruler to a portable machining apparatus by using a pressing member supported on a distal end of an external threaded fastener in a manner rotatable about an axis and tightening the external threaded fastener to press the pressing member against a leg of the parallel ruler.

Japanese Unexamined Patent Application Publication No. 2018-39100 (hereafter, Patent Literature 3) describes a technique for tightening an external threaded fastener with a highly durable internal threaded fastener attached on a base, and a technique using a pressing member supported on a distal end of an external threaded portion rotatably about an axis.

BRIEF SUMMARY

With the techniques described in Patent Literatures 1 and 2, the internal thread portion is susceptible to damage caused by the external threaded fastener that may be tightened forcibly with foreign matter such as chips produced from machining remaining on the internal threaded portion of the base. The damage may cause replacement of the entire base and increase the maintenance cost.

The technique described in Patent Literature 3 uses the highly durable internal threaded fastener separate from the base. When damaged, the internal threaded fastener alone can be removed from the base for replacement. This decreases the maintenance cost. However, the assembly of the portable machining apparatus involves an additional process for attaching, to the base, the separate internal threaded fastener together with a compression spring for locking the external threaded fastener. The process is time-consuming and can be troublesome, increasing maintenance.

One or more aspects of the present disclosure are directed to an attachment structure with simpler assembly and maintenance for attaching an auxiliary fitting such as a parallel ruler to a portable machining apparatus.

A first aspect of the present disclosure provides a portable machining apparatus, including:

- a base having a lower surface to be in contact with a workpiece;
- a machining body supported on an upper surface of the base; and
- a mount configured to receive an auxiliary fitting removably attachable to the base, the mount including
  - an internal threaded fastener detachably supported on the base,
  - an external threaded fastener screwed with the internal threaded fastener to be tightened with the internal threaded fastener to press the auxiliary fitting onto the base, and
  - a locking section configured to lock the external threaded fastener with respect to the internal threaded fastener.

When the internal threaded portion is damaged, for example, the internal threaded fastener alone may be removed from the base for replacement. This decreases the maintenance cost, as compared with known structures that may involve replacement of the entire base.

A locking section can lock the external threaded fastener. Either the internal threaded fastener or the external threaded fastener may include the locking section. This thus simplifies the assembly of an attachment portion for the auxiliary fitting, compared with known structures that use a member separate from the internal threaded fastener or the external threaded fastener, such as a compression spring, for locking the external threaded fastener.

The internal threaded fastener including the locking section may be, for example, a nylon nut having a ring made of polyamide attached adjacent to a threaded hole (JIS B1199-1, nylon is a registered trademark) or a locknut having a metal ring attached in a threaded hole. For example, the locking section may include metal threaded portions integral with each other that are deformed elastically as in, for example, a Hardlock Nut (registered trademark).

A second aspect of the present disclosure provides a portable machining apparatus, including:

- a base having a lower surface to be in contact with a workpiece;
- a machining body supported on an upper surface of the base; and
- a mount configured to receive an auxiliary fitting removably attachable to the base, the mount including
  - an internal threaded fastener detachably supported on the base,
  - an external threaded fastener screwed with the internal threaded fastener to be tightened with the internal threaded fastener to press the auxiliary fitting onto the base, and
  - a leaf spring between the external threaded fastener and the auxiliary fitting and attached to the base, the leaf spring supporting the internal threaded fastener to the base with the external threaded fastener.

When the internal threaded portion is damaged, for example, the internal threaded fastener alone may be removed from the base for replacement. This decreases the maintenance cost, as compared with known structures that may involve replacement of the entire base. The leaf spring is between the external threaded fastener and the auxiliary fitting to prevent misalignment of the auxiliary fitting when the external threaded fastener is tightened. The leaf spring allows the internal threaded fastener to be supported on the base with the external threaded fastener. The simple structure can support the internal threaded fastener, allowing easy attachment and detachment of the internal threaded fastener. This simplifies the assembly of an attachment portion for an auxiliary fitting. The leaf spring, placed between the external threaded fastener and the auxiliary fitting, can also support the internal threaded fastener.

DETAILED DESCRIPTION

Embodiments of the disclosure will now be described with reference to FIGS. 1 to 12. FIGS. 1 to 6 show a portable machining apparatus 1 according to one embodiment. The portable machining apparatus 1 is referred to as a portable circular saw. The portable machining apparatus 1 includes a base 2 and a machining body 10. The base 2, which is a rectangular flat plate, is placed in contact with the upper surface of a workpiece W. The machining body 10 is supported on the upper surface of the base 2.

A user, facing the rear of the portable machining apparatus 1, moves the portable machining apparatus 1 forward to perform cutting. The components and structures will be described herein by referring to the front-rear direction with the front being the direction of cutting and the rear being where the user stays. Also, the left-right direction is defined as viewed from the user.

Figure 2:
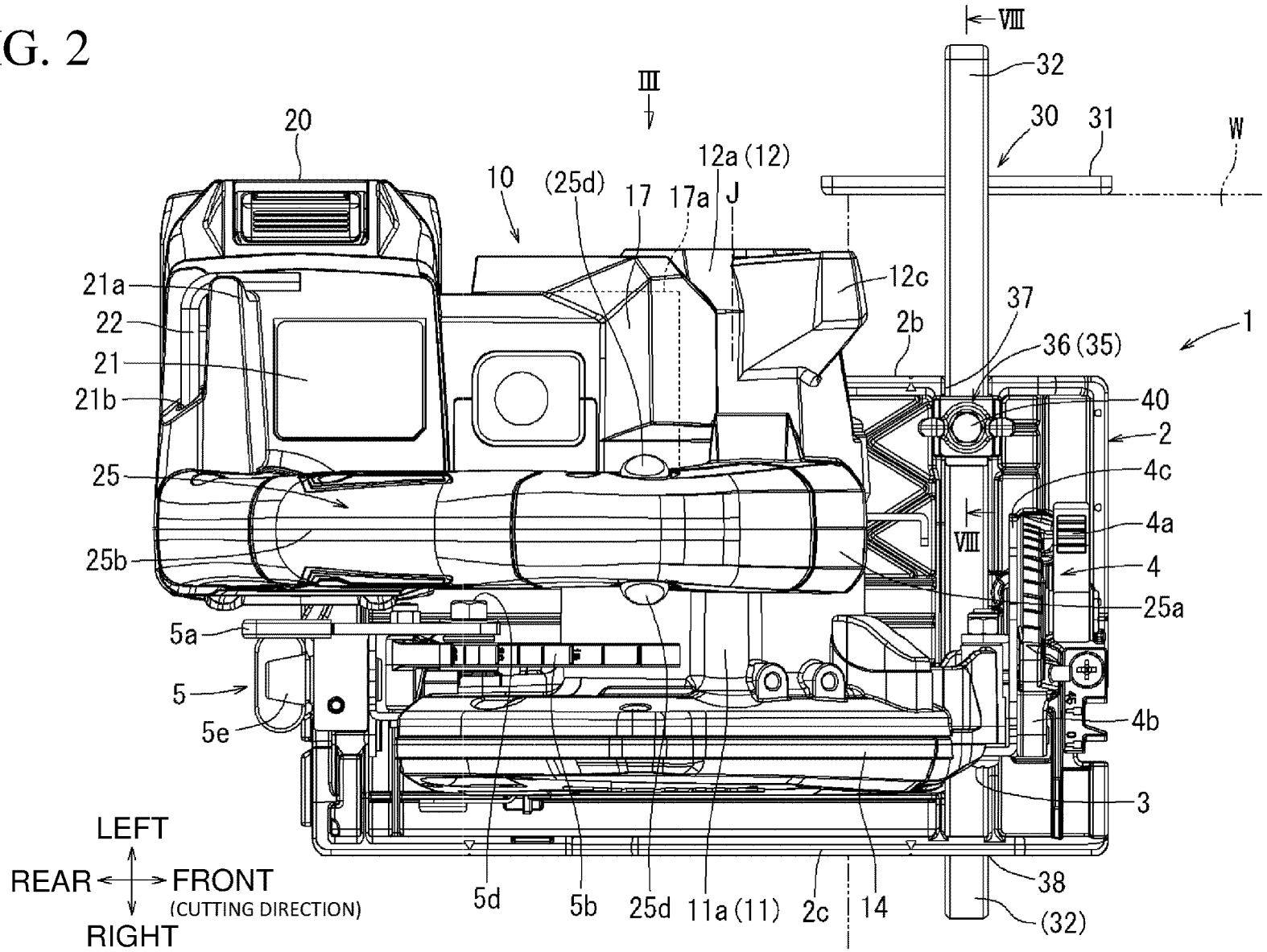
FIG. 2 is a top view of the portable machining apparatus as viewed in the direction indicated by arrow II in FIG. 1.
Figure 4:
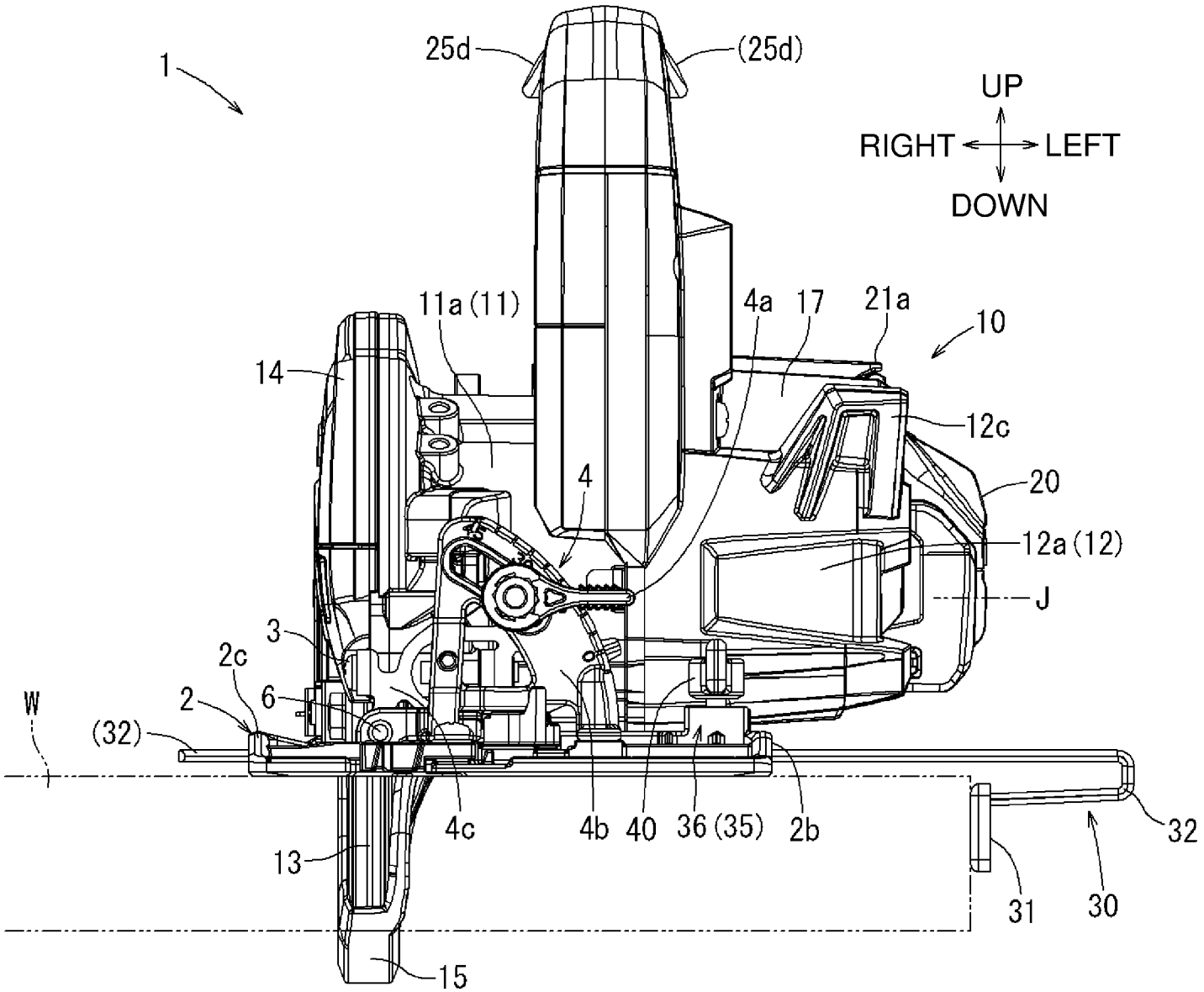
FIG. 4 is a front view of the portable machining apparatus as viewed in the direction indicated by arrow IV in FIG. 3.
Figure 5:
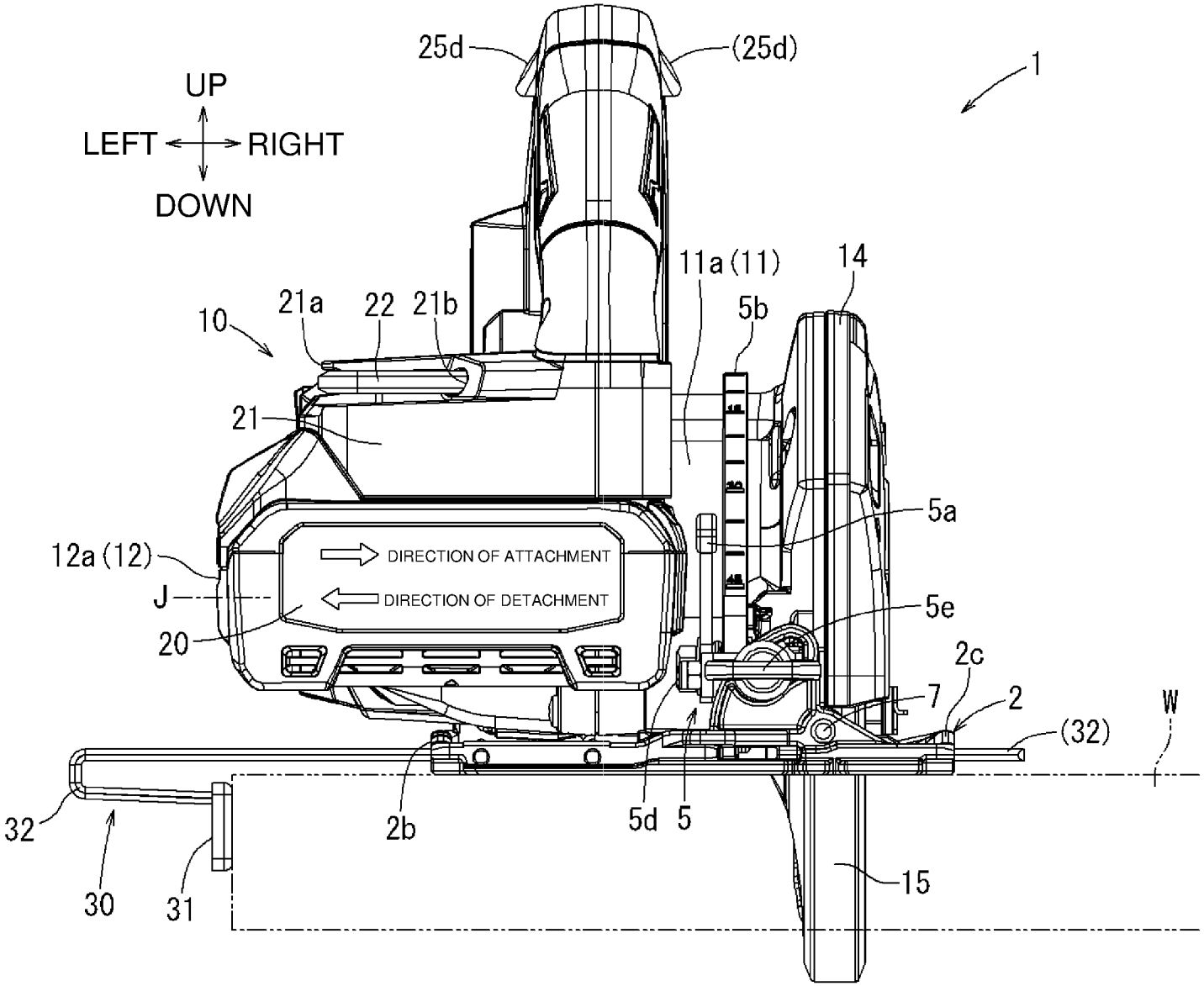
FIG. 5 is a rear view of the portable machining apparatus as viewed in the direction indicated by arrow V in FIG. 3.

The machining body 10 includes a disk-shaped blade 13, which is referred to as a chip saw. The blade 13 rotates as driven by an electric motor 12. The blade 13 has an upper portion covered with a stationary cover 14. As shown in FIGS. 2, 4, and 5, the stationary cover 14 receives the electric motor 12 installed on its right side surface, with a reduction gear unit 11 between them. The electric motor 12 is accommodated in a cylindrical motor housing 12*a*. The electric motor 12 is installed to have its motor axis (output axis) J in the left-right direction. The electric motor 12 is, for example, a brushless motor.

Figure 3:
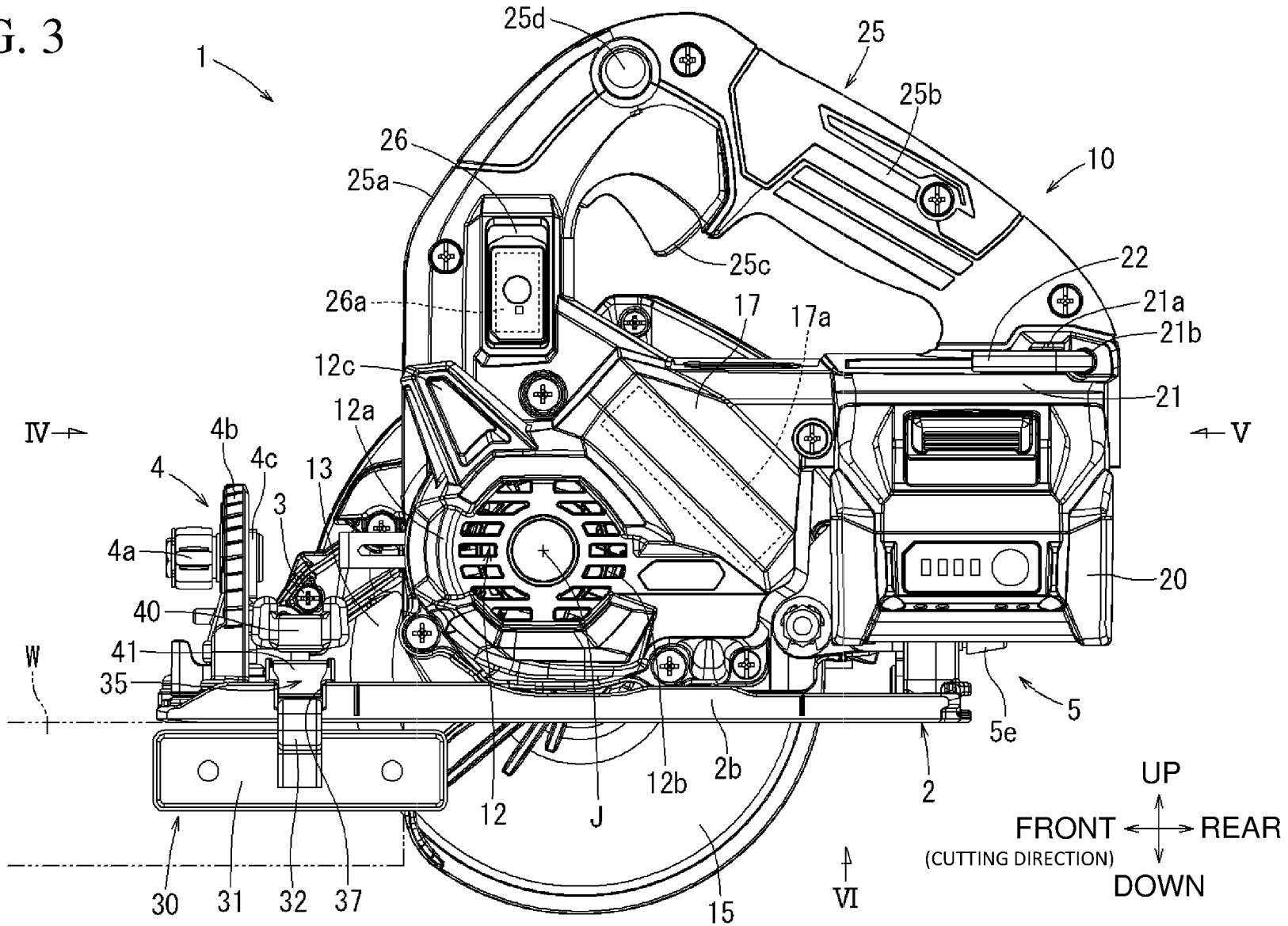
FIG. 3 is a left side view of the portable machining apparatus as viewed in the direction indicated by arrow III in FIG. 2.

As shown in FIG. 3, the motor housing 12*a* has an air inlet 12*b* on its left side surface for drawing in outside air. A cooling fan (not shown) is mounted on the output shaft of the electric motor 12. The electric motor 12 is activated to rotate the cooling fan, which draws in outside air into the motor housing 12*a* through the air inlet 12*b* to cool the electric motor 12.

The motor housing 12*a* has a leg 12*c* on its upper part for placement on the ground in an inverted orientation. When the portable machining apparatus 1 is placed in an inverted orientation with the lower surface of the base 2 facing upward, the leg 12*c*, the upper portion of a handle 25, and the front corner of the base 2 are placed on the ground. The portable machining apparatus 1 can thus be placed stably in the inverted orientation. This allows the user to temporarily release the hand from the portable machining apparatus 1 and place the apparatus in a stable orientation for breaks during the machining work.

The reduction gear unit 11 is housed in a cylindrical gear housing 11*a*. The reduction gear unit 11 includes a gear train with spur gears meshing together. The rotational output from the electric motor 12 is reduced by the reduction gear unit 11 and is then output to a spindle 13*a* on which the blade 13 is attached. The spindle 13*a* has a distal end protruding from the gear housing 11*a* into the stationary cover 14, to which the blade 13 is attached. The blade 13 is fastened to the spindle 13*a* with a fastener screw tightened onto the distal end of the spindle 13*a*.

As shown in FIGS. 1, 3, 4, and 5, the blade 13 has its lower portion protruding downward through a window 2*a* of the base 2. The lower portion protruding from the lower surface of the base 2 cuts into the workpiece W to perform cutting. The blade 13 has a lower edge (cutting edge) protruding from the lower surface of the base 2. The lower edge of the blade 13 is covered with a movable cover 15.

Figure 6:
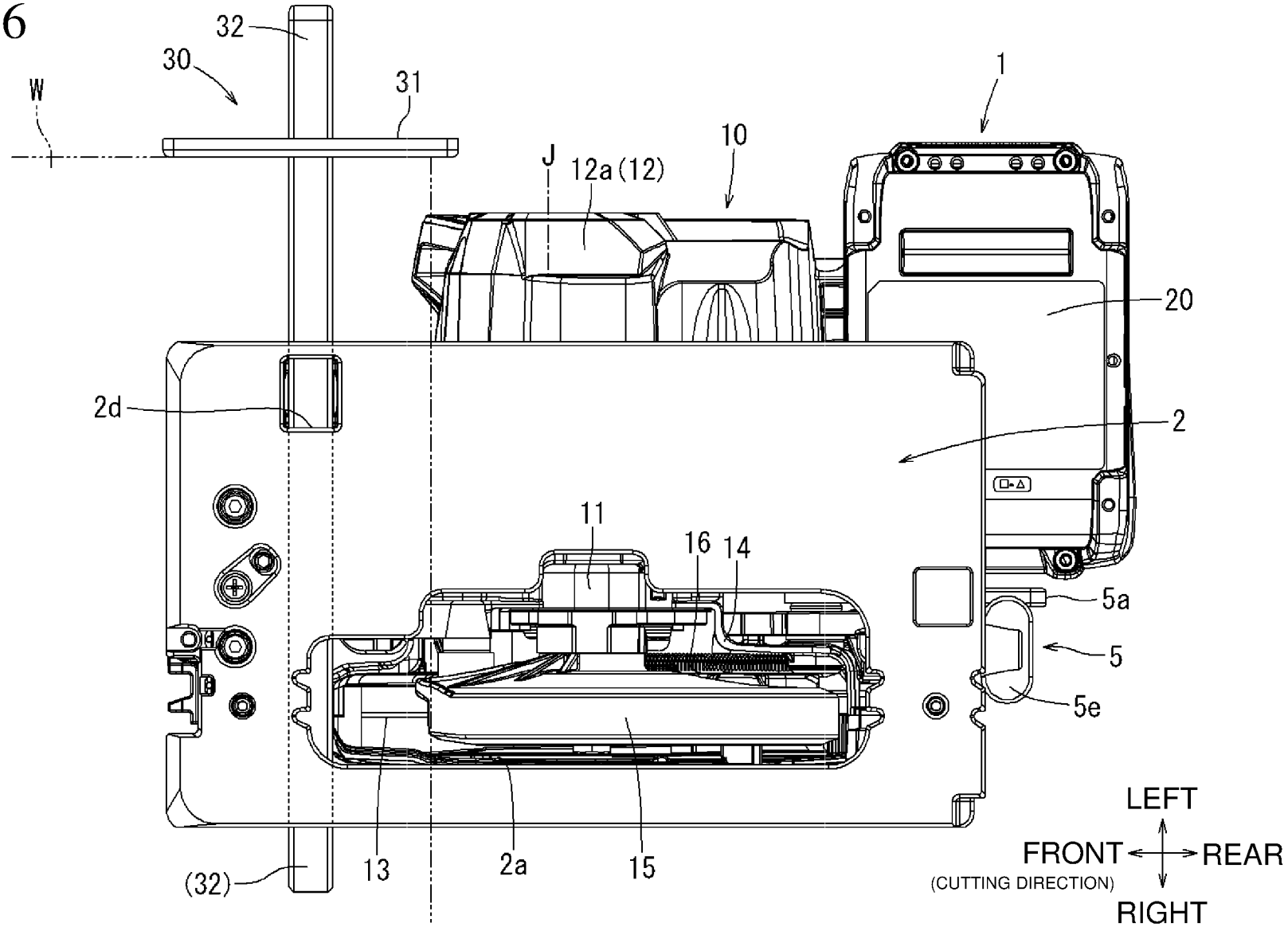
FIG. 6 is a bottom view of the portable machining apparatus as viewed in the direction indicated by arrow VI in FIG. 3.

The movable cover 15 is supported in a manner rotatable substantially about a rotation center (spindle 13*a*) of the blade 13 with respect to the stationary cover 14. The movable cover 15 is open to uncover the edge of the blade 13 when rotated clockwise in FIG. 1. The movable cover 15 is closed to cover the edge of the blade 13 when rotated counterclockwise in FIG. 1. As shown in FIG. 6, a tension spring 16 is placed between the movable cover 15 and the stationary cover 14. The movable cover 15 is urged in the closing direction by the tension spring 16.

As shown in FIG. 3, a controller compartment 17 is located at the rear of the motor housing 12*a*. A controller 17*a*, which is a rectangular flat plate, is accommodated in the controller compartment 17. The controller 17*a* controls the operation of the electric motor 12. The controller 17*a* includes a control board receiving a control circuit. The control circuit transmits a control signal based on positional information about a rotor detected by a sensor board included in the electric motor 12. The control board in the controller 17*a* also receives a drive circuit. The drive circuit switches a current flowing through the electric motor 12 in response to a control signal received from the control circuit. The control board further receives an automatic stop circuit. The automatic stop circuit cuts power supply to the electric motor 12 to prevent overdischarge or overcharge in accordance with the detected status of a battery pack 20.

A battery mount 21 is located behind the controller compartment 17. The battery mount 21 is substantially flat and extends horizontally rearward. The battery mount 21 receives, on its lower surface, a single rectangular battery pack 20.

The battery pack 20 is slid along the lower surface of the battery mount 21 for attachment and detachment. For attachment, the battery pack 20 is slid rightward on the battery mount 21 as shown in FIG. 5. For detachment, the battery pack 20 is slid leftward on the battery mount 21. The electric motor 12 is powered by the battery pack 20.

As shown in FIGS. 2 and 5, the battery mount 21 may hold a single hexagonal bar spanner 22 on its upper surface. The hexagonal bar spanner 22 has one end elastically pinched and held by a bifurcating portion 21*a* on the upper surface of the battery mount 21, and the other end placed and held in a receptacle hole 21*b* in the upper surface of the battery mount 21.

The looped handle 25 extends from an area around the joint between the motor housing 12*a* and the gear housing 11*a* to an area around the rear upper surface of the battery mount 21. The handle 25 includes a standing portion 25*a* and a grip 25*b*. The standing portion 25*a* extends upward from near the joint between the motor housing 12*a* and the gear housing 11*a*. The grip 25*b* extends rearward and downward from an upper portion of the standing portion 25*a*. The grip 25*b* has a rear portion joined to near the rear upper surface of the battery mount 21. A trigger switch lever 25*c* is placed on the lower surface near the joint between the standing portion 25*a* and the grip 25*b*. A user grips the grip 25*b* and moves the portable machining apparatus 1. The user also pulls the switch lever 25*c* to activate the electric motor 12.

The handle 25 has a lock-off button 25*d* above the switch lever 25*c*. The lock-off button 25*d* protrudes from both the left and right sides of the handle 25. Without the lock-off button 25*d* being pressed, the switch lever 25*c* remains locked and cannot be pulled (locked state). Either side of the lock-off button 25*d* is pressed to unlock the locked state of the switch lever 25*c* and allows the switch lever 25*c* to be pulled. When the pulled switch lever 25*c* is released, the lock-off button 25*d* that has been pressed is released to lock the switch lever 25*c* again. The switch lever 25*c* is locked and is thus prevented from being accidentally activated as unintended by the user.

The lock-off button 25*d* is cylindrical and extends across the width of the handle 25 in the left-right direction. The lock-off button 25*d* (operational part) has two ends protruding from the left and right sides of the handle 25. The lock-off button 25*d* can thus be pressed from either side to unlock the locked state.

As shown in FIGS. 4 and 5, the lock-off button 25*d* has the two ends with sloping surfaces that slope upward. The user can place a fingertip against the sloping surfaces of the lock-off button 25*d* and applies a downward pressing force to press the lock-off button 25*d* in the left-right direction. This allows the user to easily press the lock-off button 25*d* without any forced pose of the fingertip, thus allowing the user to easily operate the lock-off button 25*d*.

As shown in FIG. 3, the handle 25 has an adapter receptacle 26 on the left portion of the standing portion 25*a*. The adapter receptacle 26 receives a single communication adapter 26*a* for near-range wireless communication. The communication adapter 26*a* allows near-range wireless communication between the portable machining apparatus 1 and other wireless devices. Through near-range wireless communication, for example, a dust collector installed near the portable machining apparatus 1 can be stopped or started in cooperation with the start or stop of the portable machining apparatus 1. This wireless communication capability allows the operator to maintain a clean work environment and to continue the cutting work efficiently. The communication adapter 26*a* can be detached from the adapter receptacle 26. The detached communication adapter 26*a* may be used for other compatible power tools.

Figure 1:
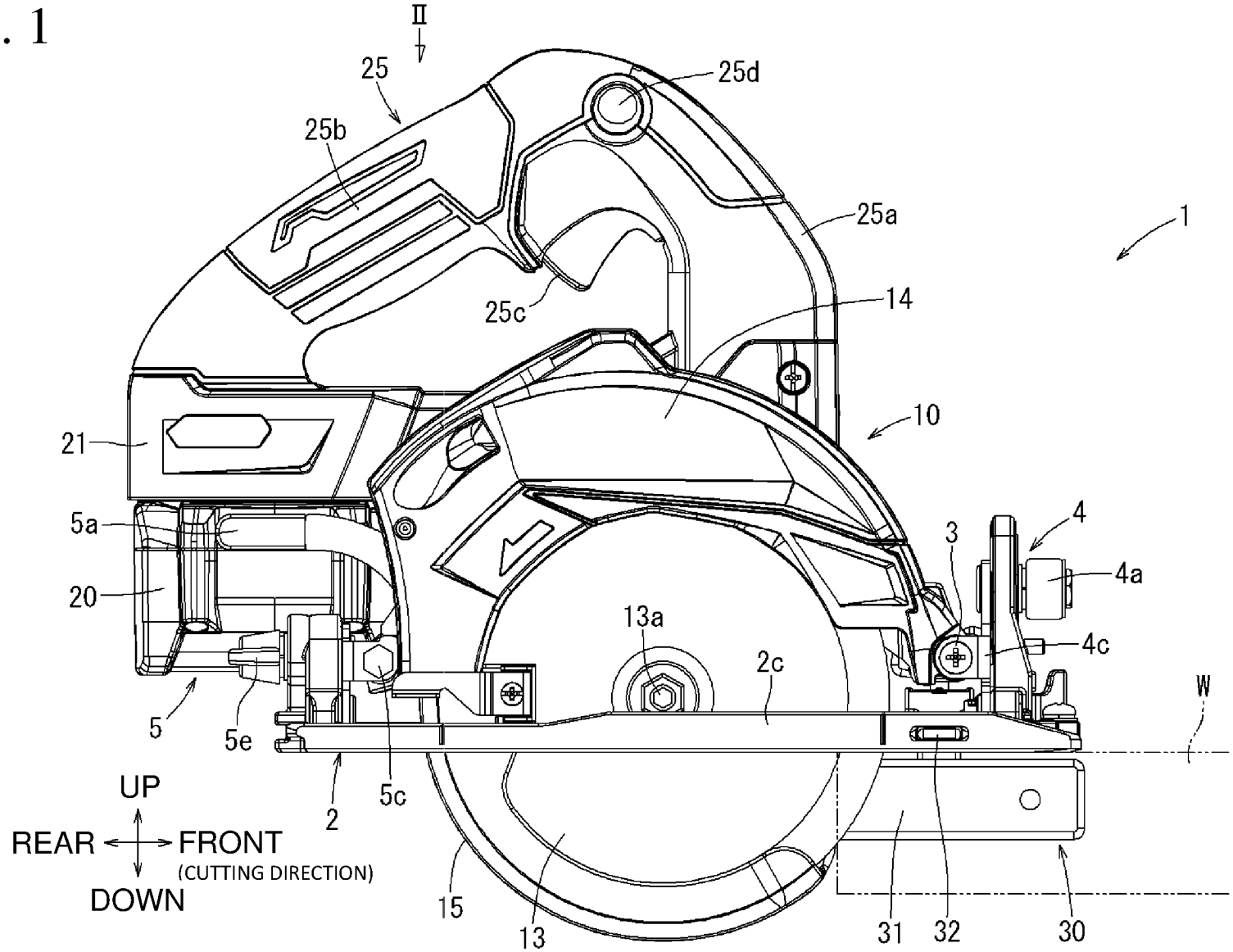
FIG. 1 is a right side view of a portable machining apparatus according to one or more embodiments.

The machining body 10 is supported on the upper surface of the base 2 with a front support 4 and a rear support 5 between them. The machining body 10 is supported by a vertical swing support shaft 3 included in the front support 4 in a vertically swingable manner relative to the base 2. The vertical swing position of the machining body 10 is changed with respect to the base 2 to change the degree by which the blade 13 protrudes from the lower surface of the base 2. This adjusts the depth of cutting into the workpiece W. In FIG. 1, the machining body 10 is swung to the lower limit with respect to the base 2 to maximize the cutting depth.

The vertical swing position of the machining body 10 with respect to the base 2 is locked by rotating a lock lever 5*a* in the rear support 5 to the lock position. The rear support 5 includes a depth guide 5*b*. The depth guide 5*b*, which is arc-shaped, is located on the upper surface of the base 2. The depth guide 5*b* is supported in a manner pivotable back and forth on a pivot support shaft 5*c*.

A fastener screw 5*d* is connected to the lock lever 5*a*. The fastener screw 5*d* is placed along a guide groove on the depth guide 5*b* and screwed with a left portion of the stationary cover 14. The lock lever 5*a* is swung downward to tighten the fastener screw 5*d*, and is swung upward to loosen the fastener screw 5*d*. The lock lever 5*a* is swung downward to tighten the fastener screw 5*d* and thus to pinch the depth guide 5*b*. This fastens the machining body 10 at the position swung upward or downward with respect to the base 2 to fix the cutting depth. The lock lever 5*a* is swung upward to loosen the fastener screw 5*d* and thus to adjust the cutting depth by swinging the machining body 10 upward or downward.

The machining body 10 is supported to be laterally tiltable with respect to the base 2 with lateral tilt support shafts 6 and 7 at the front and the rear. FIG. 4 shows the lateral tilt support shaft 6 at the front. FIG. 5 shows the lateral tilt support shaft 7 at the rear. The lateral tilt support shafts 6 and 7 at the front and the rear are coaxial. The lateral tilt position of the machining body 10 is adjusted using the lateral tilt support shafts 6 and 7 to allow the blade 13 to obliquely cut into the workpiece W to perform diagonal cutting.

A lock lever 4*a* included in the front support 4 and a thumbscrew 5*e* included in the rear support 5 are screwed to fasten the machining body 10 at a laterally tilted position or at a right-angle cutting position. The lock lever 4*a* and the thumbscrew 5*e* are loosened to allow the machining body 10 to be laterally tiltable.

As shown in FIGS. 1 to 4, an arc-shaped angular plate 4*b* stands on the front upper surface of the base 2. A tiltable bracket 4*c* is supported along the rear surface of the angular plate 4*b*. The tiltable bracket 4*c* is connected to the angular plate 4*b* in a manner laterally tiltable with the lateral tilt support shaft 6 at the front. The lock lever 4*a* is screwed to fasten the tiltable bracket 4*c* at a laterally tilted position. The machining body 10 has its front portion connected to the tiltable bracket 4*c* with the vertical swing support shaft 3 in between.

As shown in FIGS. 2 to 6, the base 2 can receive an auxiliary fitting on its front portion. An example auxiliary fitting used in the present embodiment is a parallel ruler 30. The parallel ruler 30 is used to guide the blade 13 parallel to a side surface of the workpiece W when cutting into the workpiece W. The parallel ruler 30 includes a ruler body 31 and a single leg 32. The ruler body 31 is a flat plate to be placed in contact with the side surface of the workpiece W. The leg 32 is elongated laterally from the ruler body 31. The leg 32 is fastened to the base 2 to fasten the ruler body 31 at a position with respect to the blade 13.

The parallel ruler 30 is attached to a ruler mount 35 on the front portion of the base 2. The ruler mount 35 is shown in detail in FIGS. 7 and 8. The ruler mount 35 includes a fixing unit 36 and left and right holders 37 and 38. The left and right holders 37 and 38 are located on the left and right of the base 2. The base 2 has, on its left and right, walls 2*b* and 2*c* extending upward in a folded manner. The left and right walls 2*b* and 2*c* mainly function as ribs to enhance the surface rigidity of the base 2. The holder 37 is located on the left wall 2*b*. The holder 38 is located on the right wall 2*c*.

Figure 7:
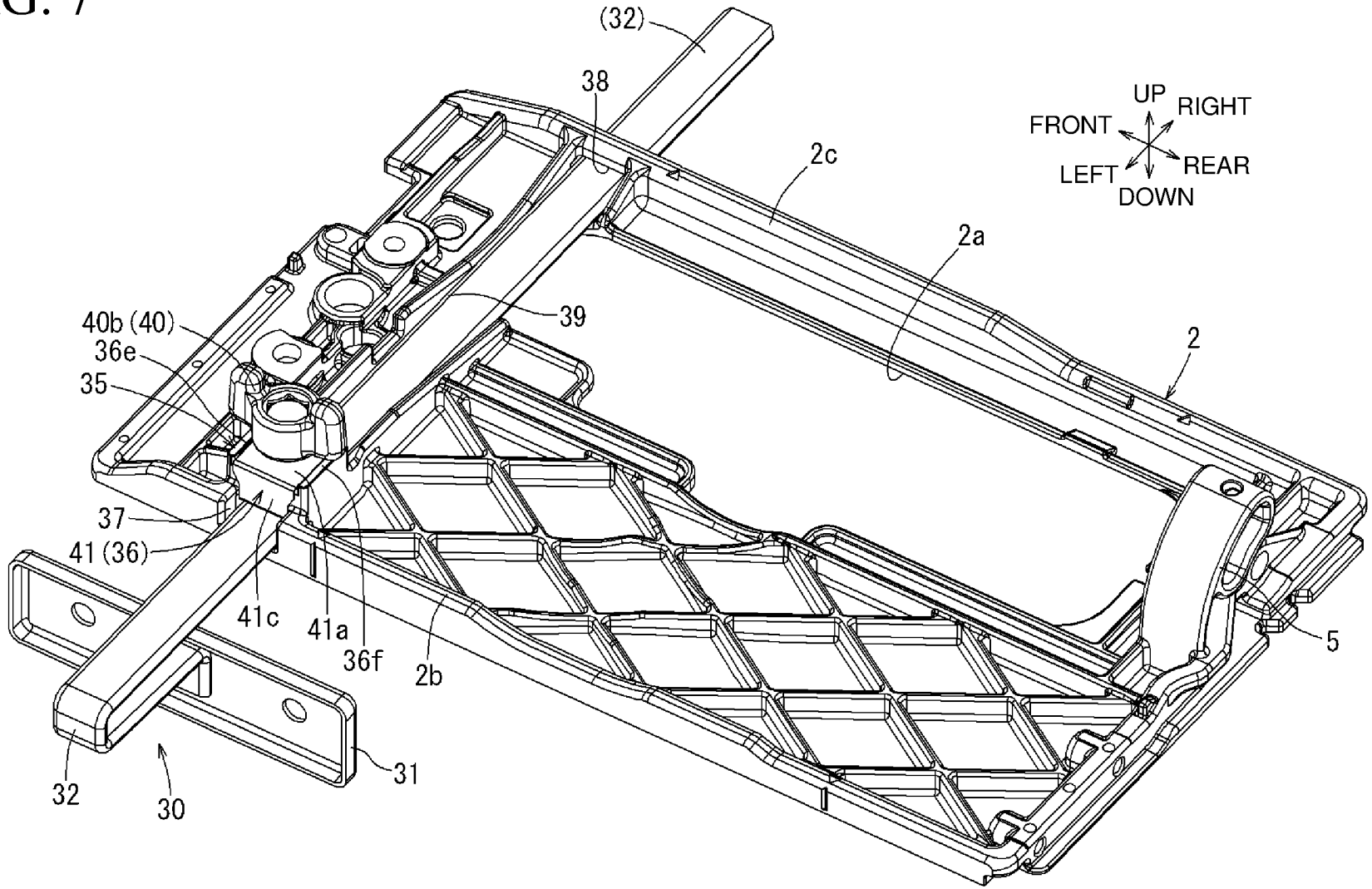
FIG. 7 is a perspective view of a base from which a machining body has been separated, also showing a parallel ruler attached to the base.

The holder 37 on the left wall 2*b* is a groove with a rectangular cross section that is open upward. The holder 38 on the right wall 2*c* is a rectangular through-hole. The leg 32 of the parallel ruler 30 is supported across and beyond the left and right holders 37 and 38. As shown in FIG. 7, a retainer groove 39 extends between the left holder 37 and the right holder 38 to receive the leg 32 without rattling.

Figures 8A, 8B:
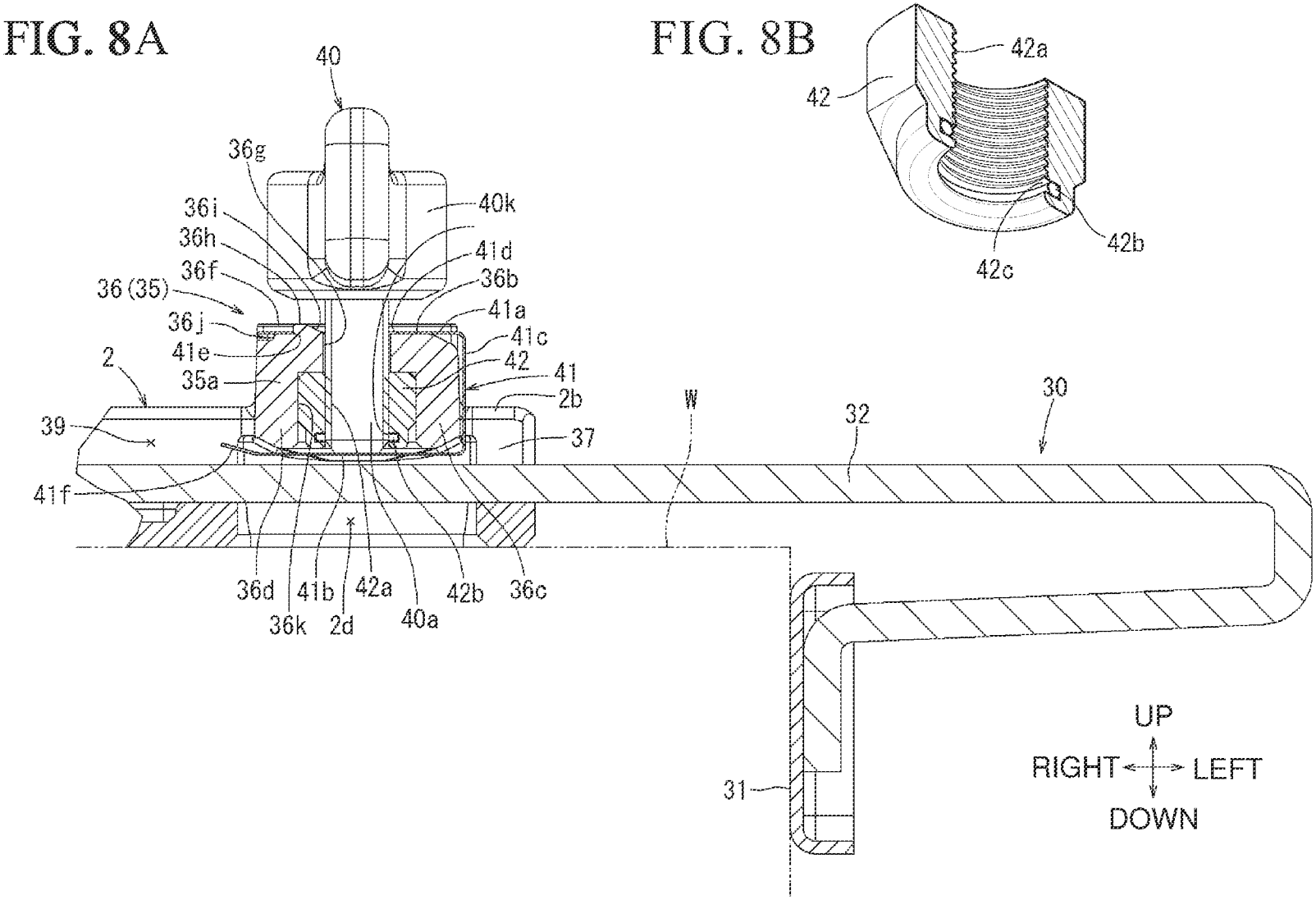
FIG. 8A is a vertical sectional view taken along line VIII-VIII in FIG. 2, showing the parallel ruler and its mount.
FIG. 8B is a perspective sectional view of the internal threaded fastener shown in FIG. 8B that can be used in certain embodiments of this invention.
Figure 9:
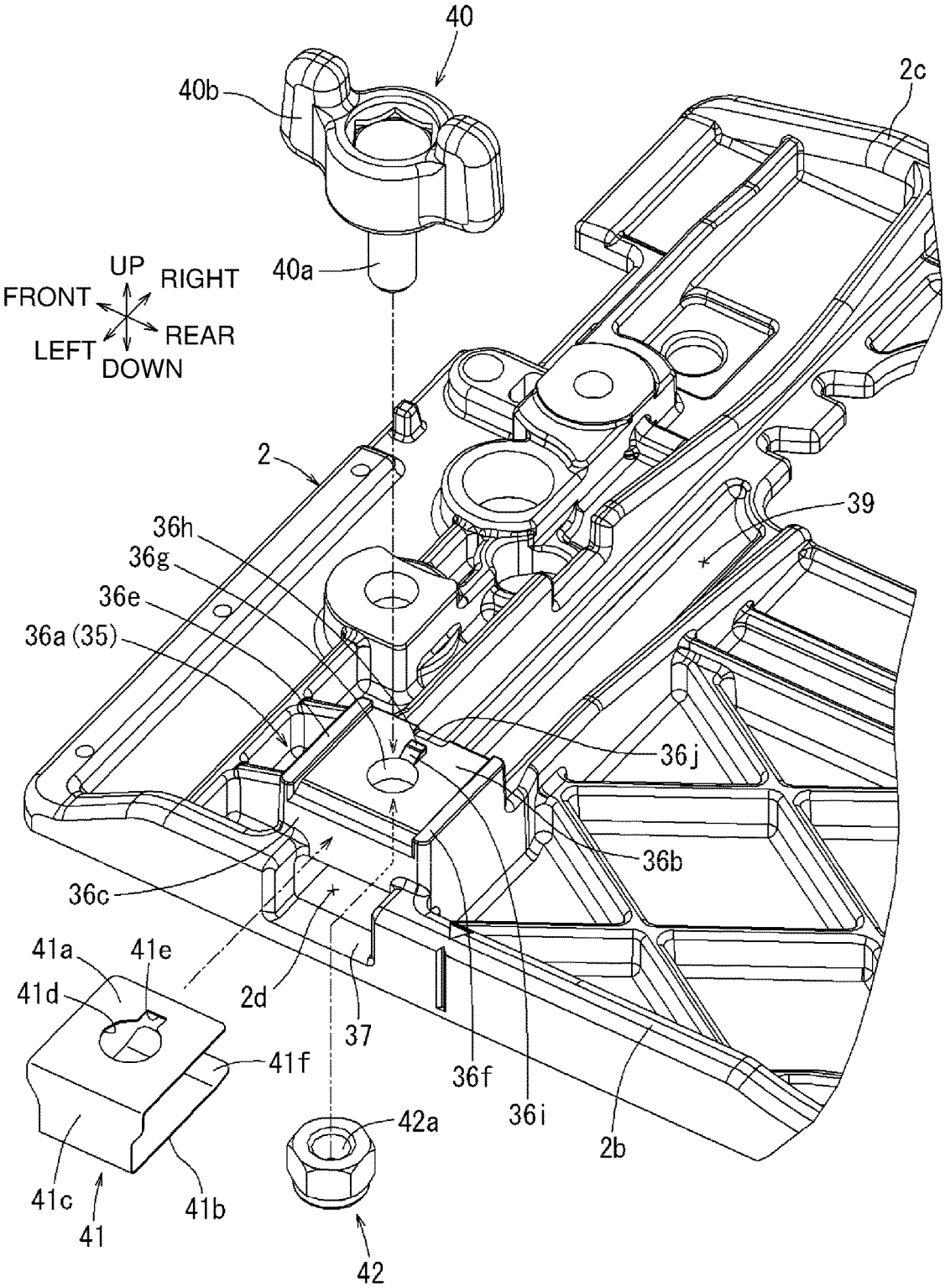
FIG. 9 is an exploded perspective view of a front part of the base to which the parallel ruler is attached.

The fixing unit 36 is adjacent to the right of the left holder 37. FIGS. 8A, 8B and 9 show the fixing unit 36 in detail. The fixing unit 36 includes a basal portion 36*a* that extends across the length of the retainer groove 39 in the front-rear direction. The basal portion 36*a* is molded integrally with the base 2 by aluminum die casting. The basal portion 36*a* includes a flat upper surface portion 36*b* and left and right walls 36*c* and 36*d*. The left and right walls 36*c* and 36*d* protrude downward from the left and right edges of the upper surface portion 36*b*. The basal portion 36*a* is displaced upward from the retainer groove 39 to allow the leg 32 of the parallel ruler 30 to be insertable below the left and right walls 36*c* and 36*d*.

Figure 10:
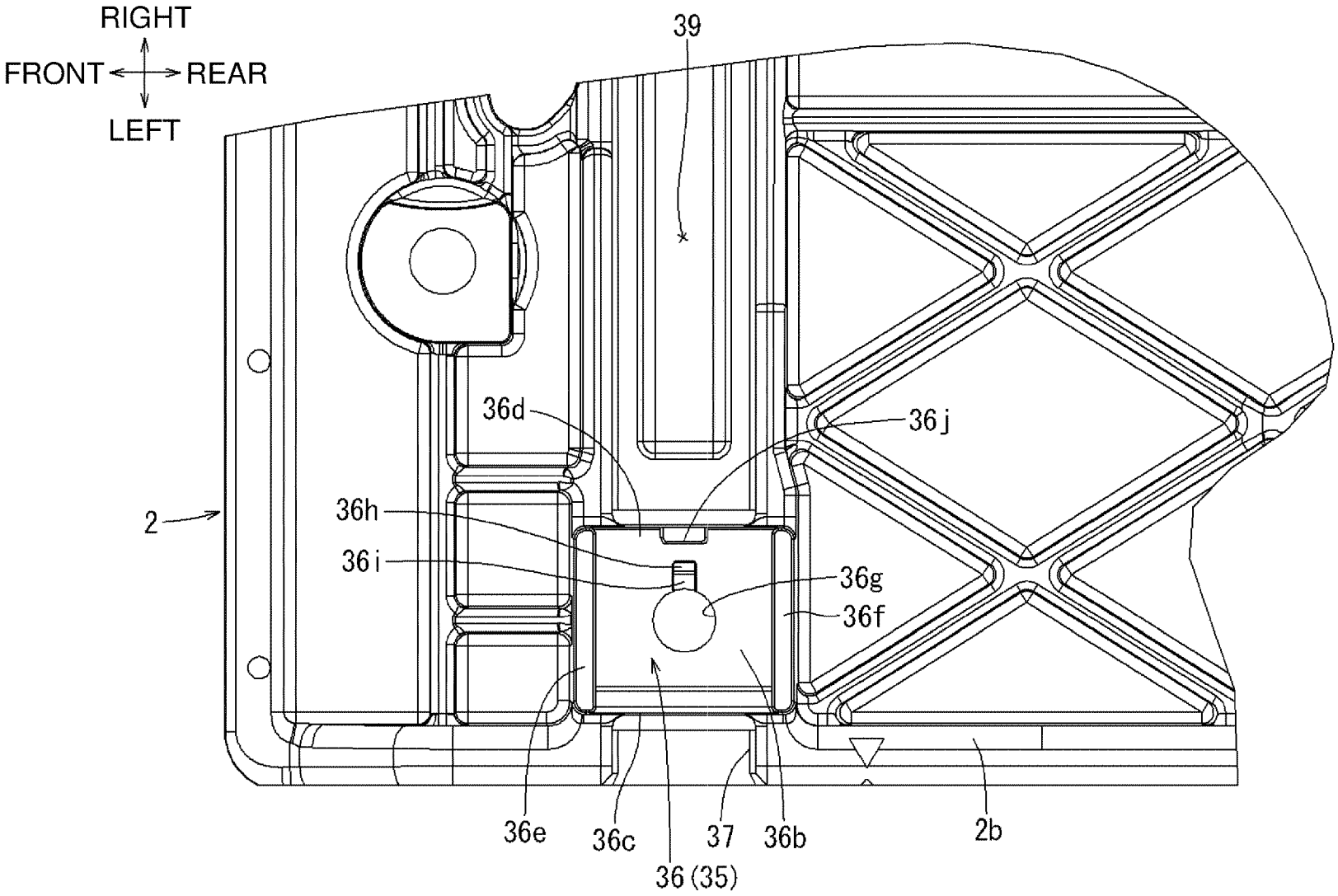
FIG. 10 is a top view of a basal portion.

As shown in FIGS. 9 and 10, retainer walls 36*e* and 36*f* are located at the front and the rear of the upper surface portion 36*b*. The front retainer wall 36*e* is along the front edge of the upper surface portion 36*b*. The rear retainer wall 36*f* is along the rear edge of the upper surface portion 36*b*. The front and rear retainer walls 36*e* and 36*f* are parallel to each other at a predetermined interval between them. The upper surface portion 36*b* has a single circular insertion hole 36*g* at the center.

The upper surface portion 36*b* has a single engagement protrusion 36*h* on the right of the insertion hole 36*g*, and a guide slope 36*i* that slopes downward toward the insertion hole 36*g* on the left of the engagement protrusion 36*h*. The upper surface portion 36*b* further has, on the right edge of the engagement protrusion 36*h*, a rectangular recess 36*j* on the right edge of the upper surface portion 36*b*. The insertion hole 36*g*, the engagement protrusion 36*h*, and the recess 36*j* will be described in detail later.

Figure 11:
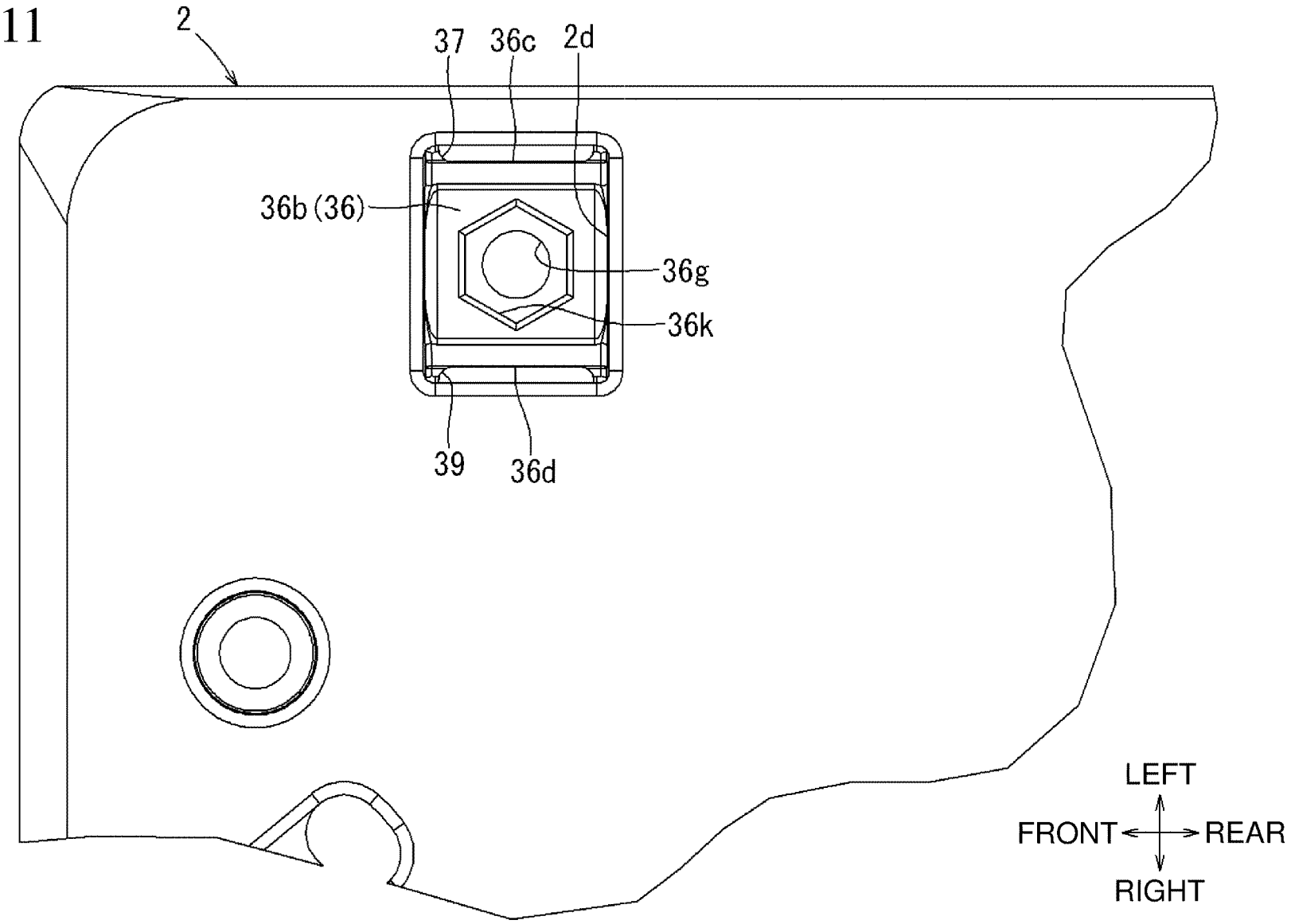
FIG. 11 is a bottom view of the basal portion.

A rectangular window 2*d* is located in a lower portion of the upper surface portion 36*b*. With the parallel ruler 30 detached, as shown in FIG. 11, the upper surface portion 36*b* has its lower surface portion exposed through the window 2*d* toward the lower surface of the base 2. As shown in FIG. 11, the upper surface portion 36*b* has a hexagonal receptacle hole 36*k* in its lower surface. The receptacle hole 36*k* is open downward. The receptacle hole 36*k* is coaxial with the insertion hole 36*g*.

As shown in FIGS. 8A, 8B and 9, the fixing unit 36 includes, in addition to the basal portion 36*a*, a single external threaded fastener 40, a single leaf spring 41, and a single internal threaded fastener 42. The external threaded fastener 40 includes a threaded shaft 40*a* and a knob 40*b*. The threaded shaft 40*a* is inserted into the insertion hole 36*g* in the upper surface portion 36*b* from above.

Figure 12:
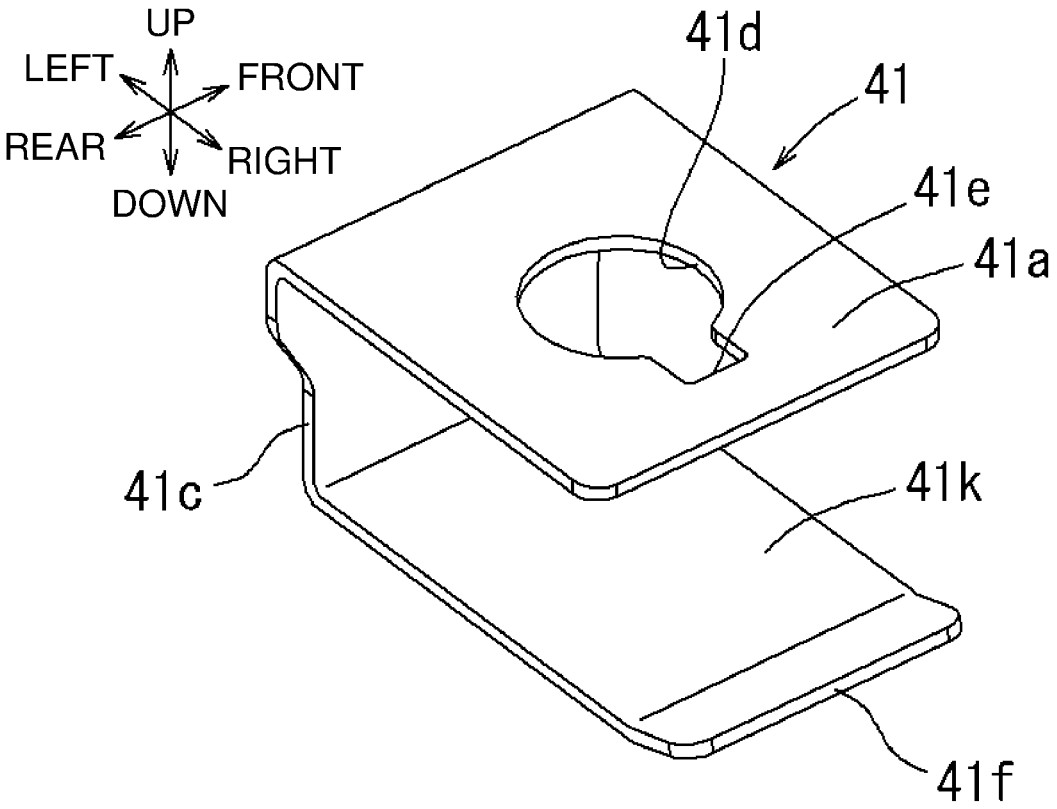

The leaf spring 41 is shown in detail in FIGS. 9 and 12. The leaf spring 41 includes a top plate 41*a*, a bottom plate 41*b*, and a connector 41*c*. The top plate 41*a* is in contact with the upper surface of the basal portion 36*a* (the upper surface portion 36*b*). The bottom plate 41*b* is located along the bottom surface of the basal portion 36*a*. The connector 41*c* connects the top plate 41*a* and the bottom plate 41*b*. The top plate 41*a* and the bottom plate 41*b* have their left ends connected by the connector 41*c*. The leaf spring 41 is thus in a C-shape as viewed from the front.

The top plate 41*a* has a circular insertion hole 41*d* at the center. The insertion hole 41*d* has a slightly larger diameter than the insertion hole 36*g* in the basal portion 36*a*. With the leaf spring 41 attached to the basal portion 36*a*, the insertion hole 41*d* is coaxial with the insertion hole 36*g* in the basal portion 36*a* and receives the threaded shaft 40*a* of the external threaded fastener 40.

The insertion hole 41*d* has, on its right, a cut, or specifically a rectangular engagement recess 41*e*. With the leaf spring 41 attached to the basal portion 36*a*, the engagement protrusion 36*h* on the basal portion 36*a* is received in the engagement recess 41*e*. The leaf spring 41 is prevented from rattling, and thus from being misaligned with or slipping off the basal portion 36*a*. The engagement protrusion 36*h* thus functions as a displacement restrictor that restricts the displacement of the leaf spring 41 in the planar direction (planar direction of the upper surface portion 36*b*).

The bottom plate 41*b* has, on its distal end, a guide 41*f* that slopes upward with a constant width. When the parallel ruler 30 is attached with the leg 32 placed into the retainer groove 39, the guide 41*f* guides the distal end of the leg 32 on a lower surface of the bottom plate 41*b*. The parallel ruler 30 can thus be attached easily.

The internal threaded fastener 42 is a hexagonal nut. The internal threaded fastener 42 is, for example, a tightening nut (a nylon nut under JISB1199-1) having a ring (locking member 42*b*) made of polyamide as a resin member placed in an annular groove 36C defined at the opening of a threaded hole 42*a*. The internal threaded fastener 42 is received in the receptacle hole 36*k* in the basal portion 36*a*. The locking member 42*b* corresponds to a locking section.

As shown in FIG. 9, the internal threaded fastener 42 is received in the receptacle hole 36*k* in the basal portion 36*a* before the leaf spring 41 is attached to the basal portion 36*a*. The internal threaded fastener 42 is received in the receptacle hole 36*k* in the basal portion 36*a* through the window 2*d* in the base 2. The internal threaded fastener 42 received in the receptacle hole 36*k* has the threaded hole 42*a* substantially coaxial with the insertion hole 36*g* in the basal portion 36*a*. With the internal threaded fastener 42 remaining received, the leaf spring 41 is attached to the basal portion 36*a* from the left. The leaf spring 41 is attached to the basal portion 36*a* by moving its portion having the opening opposite the connector 41*c* rightward toward the basal portion 36*a*.

Once the leaf spring 41 is attached to the basal portion 36*a*, the top plate 41*a* is along the upper surface portion 36*b* of the basal portion 36*a*, and the bottom plate 41*b* is along the lower surface of the basal portion 36*a*. The leaf spring 41 is attached by placing the basal portion 36*a* elastically held between the top plate 41*a* and the bottom plate 41*b*.

With the leaf spring 41 being attached, the top plate 41*a* is elastically pressed against the upper surface portion 36*b* of the basal portion 36*a*. As shown in FIGS. 7 and 8, the top plate 41*a* of the leaf spring 41 stably fits between the front and rear retainer walls 36*e* and 36*f* and is pressed against the upper surface portion 36*b*. Similarly to the engagement protrusion 36*h*, the front and rear retainer walls 36*e* and 36*f* function as a displacement restrictor that restricts the displacement of the leaf spring 41 in the planar direction (planar direction of the upper surface portion 36*b*). The insertion hole 41*d* in the leaf spring 41 and the insertion hole 36*g* in the basal portion 36*a* are substantially coaxial with each other. The engagement recess 41*e* in the leaf spring 41 receives the engagement protrusion 36*h* on the basal portion 36*a* to prevent the top plate 41*a* and thus the leaf spring 41 from accidentally slipping off the basal portion 36*a*.

When the leaf spring 41 is attached to the basal portion 36*a*, the distal end of the top plate 41*a* is guided along the guide slope 36*i* of the upper surface portion 36*b*. The engagement protrusion 36*h* can thus be smoothly received and positioned in the engagement recess 41*e* in the top plate 41*a*.

With the leaf spring 41 being attached, as shown in FIG. 8, the distal end of the top plate 41*a* covers the recess 36*j* in the basal portion 36*a*. The tip of a tool, such as a slotted screwdriver, can be placed into the recess 36*j* to easily lift the top plate 41*a* off the upper surface portion 36*b*. The engagement protrusion 36*h* can thus be easily disengaged from the engagement recess 41*e* in the leaf spring 41. The leaf spring 41 can be easily detached from the basal portion 36*a*.

With the leaf spring 41 being attached, the bottom plate 41*b* extends along the lower surface of the basal portion 36*a* to cover the receptacle hole 36*k*. The internal threaded fastener 42 remains received in the receptacle hole 36*k*.

With the leaf spring 41 attached to the basal portion 36*a*, the connector 41*c* is in contact with the left wall 36*c* of the basal portion 36*a*. The leaf spring 41 is thus aligned on the right of the basal portion 36*a* (in the direction of attachment). The engagement protrusion 36*h* is engaged in the engagement recess 41*e* to align the leaf spring 41 on the left of the basal portion 36*a* (in the direction of detachment).

With the leaf spring 41 and the internal threaded fastener 42 attached to the basal portion 36*a*, the threaded shaft 40*a* of the external threaded fastener 40 is tightened into the threaded hole 42*a* of the internal threaded fastener 42 after being placed through the insertion hole 41*d* in the leaf spring 41 and the insertion hole 36*g* in the basal portion 36*a*. As shown in FIG. 8, the distal end of the tightened threaded shaft 40*a* protrudes from the threaded hole 42*a* of the internal threaded fastener 42 and abuts against the bottom plate 41*b* of the leaf spring 41.

Once the external threaded fastener 40 is tightened sufficiently with the internal threaded fastener 42, the distal end of the threaded shaft 40*a* is pressed against the leg 32 of the parallel ruler 30 with the bottom plate 41*b* of the leaf spring 41 in between. The parallel ruler 30 can thus be attached in an immovable manner. Also, the threaded shaft 40*a* is pressed against the locking member 42*b* at the opening of the threaded hole 42*a*. The external threaded fastener 40 is thus locked on the internal threaded fastener 42.

In the portable machining apparatus 1 according to the present embodiment, the internal threaded fastener 42 to receive the external threaded fastener 40 is attached separately from the base 2. When damaged with, for example, chips produced from machining, the internal threaded fastener 42 alone may be removed from the base 2 for replacement. This decreases the maintenance cost, as compared with known structures that may involve replacement of the entire base.

The internal threaded fastener 42 is a locking nut having the locking member 42*b* made of polyamide at the opening of the threaded hole 42*a*. This structure eliminates a compression spring for locking used in known structures. This simplifies the assembly of the fixing unit 36 and reduces maintenance.

The locking section that replaces a compression spring in known structures may be any locking section in place of the locking member 42*b* made of polyamide located at the opening of the threaded hole 42*a* of the internal threaded fastener 42. For example, a material for locking may be applied to the threaded shaft 40*a* of the external threaded fastener 40 (one known method is to spray a mist of resin onto the threaded portion of the external threaded fastener and solidify the resin while remaining elastic). In some embodiments, a nut for locking (locknut) having a metal ring may be used at the opening of the threaded hole of the internal threaded fastener, or metal threaded portions may be used and deformed elastically as in, for example, a Hardlock Nut (registered trademark). Any such locking section eliminates a pressing member used for locking in known structures, such as a compression spring. This simplifies the assembly of the attachment portion for the auxiliary fitting and reduces maintenance.

The ruler mount 35 as illustrated allows the bottom plate 41*b* of the leaf spring 41 to be between the threaded shaft 40*a* of the external threaded fastener 40 and the leg 32. The press from the external threaded fastener 40 is transmitted to the leg 32 through the bottom plate 41*b*. In this structure, the tightening force (rotational torque) in the external threaded fastener 40 is received by the bottom plate 41*b* of the leaf spring 41 without being transmitted to the leg 32. This prevents misalignment of the leg 32 and thus of the parallel ruler 30 when the external threaded fastener 40 is tightened.

The leaf spring 41 is attached to the basal portion 36*a* on the base 2. With the external threaded fastener 40, the internal threaded fastener 42 is supported on the basal portion 36*a* of the base 2 with the bottom plate 41*b* on the leaf spring 41. The simple structure can support the internal threaded fastener 42 on the base 2, allowing easy attachment and detachment of the internal threaded fastener 42. The leaf spring 41, placed between the external threaded fastener 40 and the leg 32, can also hold the internal threaded fastener 42.

The leaf spring 41 has the top plate 41*a* in contact with the upper surface portion 36*b* of the basal portion 36*a* and the bottom plate 41*b* between the external threaded fastener 40 and the leg 32 of the parallel ruler 30. The connector 41*c* connects the top plate 41*a* and the bottom plate 41*b*. Under an elastic force from the leaf spring 41 having a C-shape as viewed from the front, the basal portion 36*a* is elastically between the top plate 41*a* and the bottom plate 41*b*, allowing attachment of the leaf spring 41 to the basal portion 36*a*. This simplifies the attachment structure for attaching the leaf spring 41 to the basal portion 36*a*, allowing easy attachment and detachment of the leaf spring 41. Under an elastic force from the leaf spring 41, the internal threaded fastener 42 is elastically pressed and supported against the receptacle hole 36*k* in the basal portion 36*a* with the bottom plate 41*b* and the external threaded fastener 40. The internal threaded fastener 42 can be easily detached from the basal portion 36*a*.

The basal portion 36*a* includes the displacement restrictor. The displacement restrictor restricts the leaf spring 41 from being displaced in the planar direction orthogonal to the tightening direction of the external threaded fastener 40. The displacement restrictor includes the engagement protrusion 36*h* and the front and rear retainer walls 36*e* and 36*f*. This structure restricts the leaf spring 41 from being displaced in the planar direction (planar direction of the upper surface portion 36*b*) to prevent the leaf spring 41 from accidentally slipping off the basal portion 36*a*.

The basal portion 36*a* has the recess 36*j* in the upper surface portion 36*b* to allow a tool such as a slotted screwdriver to be inserted between the upper surface portion 36*b* and the top plate 41*a* of the leaf spring 41. The leaf spring 41 can be easily detached from the basal portion 36*a*.

The leaf spring 41 has the guide 41*f* sloping upward at the distal end of the bottom plate 41*b*. When the parallel ruler 30 is attached by placing the leg 32 into the retainer groove 39, the distal end of the leg 32 is guided along the guide 41*f* on the lower surface of the bottom plate 41*b*. The parallel ruler 30 can thus be attached easily.

The above embodiment may be modified variously. For example, the fixing unit 36 in the ruler mount 35, which is located adjacent to the left holder 37 on the base 2, may be located in the middle in the width direction of the base 2 or adjacent to the right holder 38. The fixing unit 36 may be provided at each of multiple positions, rather than at a single location.

The locking section that prevents the external threaded fastener 40 from loosening with respect to the internal threaded fastener 42 may be a known section including a compression spring. In this structure, a compression spring may be between the knob 40*b* on the external threaded fastener 40 and the upper surface portion 36*b* of the basal portion 36*a*. This eliminates the locking section such as the locking member 42*b* made of polyamide used in the above embodiment.

Although the parallel ruler 30 is used as an auxiliary fitting for the portable machining apparatus 1, the attachment structure illustrated for an auxiliary fitting may be used to attach any other auxiliary fitting, such as a long ruler adapter or a divided sub-base for edge cutting, to the base.

Although the portable machining apparatus 1 is a portable cutting machine that may also be referred to as a portable circular saw in the above embodiment, the attachment structure illustrated for an auxiliary fitting may be used for other portable machining apparatuses such as a cutter, a router, and a jigsaw. The portable machining apparatus may operate on a utility alternating current (AC) of 100 V, rather than operating on direct current (DC) from the battery pack.

REFERENCE SIGNS LIST

1 portable machining apparatus (portable circular saw)
W workpiece
2 base
2*a* window
2*b* wall (left)
2*c* wall (right)
2*d* window
3 vertical swing support shaft
4 front support
4*a* lock lever
4*b* angular plate
4*c* tiltable bracket
5 rear support
5*a* lock lever
5*b* depth guide
5*c* pivot support shaft
5*d* fastener screw
5*e* thumbscrew
6 lateral tilt support shaft (front)
7 lateral tilt support shaft (rear)
10 machining body
11 reduction gear unit
11*a* gear housing
12 electric motor
12*a* motor housing
12*b* air inlet
12*c* leg
J motor axis
13 blade
13*a* spindle
14 stationary cover
15 movable cover
16 tension spring
17 controller compartment
17*a* controller
20 battery pack
21 battery mount
21*a* bifurcating portion
21*b* receptacle hole
22 hexagonal bar spanner
25 handle
25*a* standing portion
25*b* grip
25*c* switch lever
25*d* lock-off button
26 adapter receptacle
26*a* communication adapter
30 parallel ruler (auxiliary fitting)
31 ruler body
32 leg
35 ruler mount
36 fixing unit
36*a* basal portion
36*b* upper surface portion
36*c* wall (left)
36*d* wall (right)
36*e* retainer wall (front)
36*f* retainer wall (rear)
36*g* insertion hole
36*h* engagement protrusion
36*i* guide slope
36*j* recess
36*k* receptacle hole
37 holder (left)
38 holder (right)
39 retainer groove
40 external threaded fastener
40*a* threaded shaft
40*b* knob
41 leaf spring
41*a* top plate
41*b* bottom plate
41*c* connector
41*d* insertion hole
41*e* engagement recess
41*f* guide
42 internal threaded fastener (locking nut)
42*a* threaded hole
42*b* locking member (locking section)

What is claimed is:

1. A portable machining apparatus, comprising:

a base (i) having a lower surface configured to contact a workpiece and (ii) including a basal portion;

a machining body supported on an upper surface of the base; and a mount configured to receive and retain an auxiliary fitting removably attachable to the base, the mount including an internal threaded fastener separate from and detachably supported on the base, an external threaded fastener configured to engage the internal threaded fastener and to be tightened with the internal threaded fastener to press the auxiliary fitting against the base, and a leaf spring (i) between the external threaded fastener and the auxiliary fitting, (ii) attached to the base, and (iii) containing the internal threaded fastener and the basal portion when attached to the base, wherein:

the leaf spring includes a top plate in contact with a top surface of the basal portion, a bottom plate between (i) the external threaded fastener and the basal portion and (ii) the auxiliary fitting, and a connector connecting the top plate and the bottom plate;

the leaf spring and the basal portion are configured such that the top plate and the bottom plate of the leaf spring exert a compression force, originating from a spring force of the leaf spring, on the upper surface of the basal portion and a lower surface of the basal portion that is opposite from the upper surface of the basal portion at all times when the internal threaded fastener is contained in the leaf spring;

the leaf spring is configured such that the top plate and the bottom plate sandwich the internal threaded fastener via the compression force at all times when the internal threaded fastener is contained in the leaf spring;

the top plate has (i) a circular opening that receives the external threaded fastener and (ii) a recess that extends radially from the circular opening; and the base includes an engaging protrusion received in the recess.

2. The portable machining apparatus according to claim 1, further comprising:

an engaging protrusion between the leaf spring and the base configured to restrict displacement of the leaf spring in a planar direction orthogonal to a tightening direction of the external threaded fastener.

3. The portable machining apparatus according to claim 1, wherein the basal portion has a recess to allow placement of a tool between the basal portion and the leaf spring.

4. The portable machining apparatus according to claim 1, wherein the leaf spring includes a guide including a distal end of the bottom plate extending diagonally away from the auxiliary fitting in a direction in which the auxiliary fitting is attachable to the base.

* * * * *